US010511093B2

(12) United States Patent
Shamblin et al.

(10) Patent No.: US 10,511,093 B2
(45) Date of Patent: Dec. 17, 2019

(54) ACTIVE UHF/VHF ANTENNA

(71) Applicant: ETHERTRONICS, INC., San Diego, CA (US)

(72) Inventors: John Shamblin, San Diego, CA (US); Rowland Jones, San Diego, CA (US); Jeffrey Shamblin, San Marcos, CA (US); Michael Roe, San Diego, CA (US); Dhaval Bhavnagari, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 15/824,956

(22) Filed: Nov. 28, 2017

(65) Prior Publication Data

US 2018/0351253 A1 Dec. 6, 2018

Related U.S. Application Data

(60) Provisional application No. 62/427,071, filed on Nov. 28, 2016.

(51) Int. Cl.

| | |
|---|---|
| ***H01Q 5/335*** | (2015.01) |
| ***H01Q 5/328*** | (2015.01) |
| ***H01Q 1/24*** | (2006.01) |
| ***H01Q 9/42*** | (2006.01) |
| ***H01Q 21/24*** | (2006.01) |
| ***H01Q 5/321*** | (2015.01) |

(Continued)

(52) U.S. Cl.

CPC ..... *H01Q 5/335* (2015.01); *H01Q 3/247* (2013.01); *H01Q 5/328* (2015.01); *H01Q 5/385* (2015.01); *H01Q 5/392* (2015.01); *H01Q 21/29* (2013.01)

(58) Field of Classification Search

None

See application file for complete search history.

(56) References Cited

U.S. PATENT DOCUMENTS

| | | | |
|---|---|---|---|
| 3,454,950 | A | 7/1969 | Grant et al. |
| 3,475,759 | A | 10/1969 | Winegard |

(Continued)

OTHER PUBLICATIONS

PCT International Search Report and Written Opinion for corresponding PCT Application No. PCT/US2017/063528, dated Jun. 7, 2018, 5 pages.

(Continued)

*Primary Examiner* — Howard Williams

(74) *Attorney, Agent, or Firm* — Dority & Manning, P.A.

(57) ABSTRACT

An active antenna for UHF/VHF signal receiving is described, the active antenna being capable of configuration in one of a plurality of possible modes. The active antenna includes an antenna element configured for multiple resonances in the UHF/VHF bands, and capable of generating multiple radiation modes as well as active impedance matching using a microprocessor and multi-port switch having variable or multiple selectable modes. The active antenna may include a second antenna element arranged in a right-angle orientation with respect to the first antenna element. The first antenna element, second antenna element, or a combination may be selected for receiving signals in at a desired frequency. A three-dimensional antenna assembly is also described. Each of the examples illustrate an active beam steering antenna capable of UHF/VHF signal receiving.

21 Claims, 6 Drawing Sheets

(51) Int. Cl.

| | |
|---|---|
| ***H01Q 5/385*** | (2015.01) |
| ***H01Q 5/392*** | (2015.01) |
| ***H01Q 3/24*** | (2006.01) |
| ***H01Q 21/29*** | (2006.01) |

(56) References Cited

U.S. PATENT DOCUMENTS

| | | | | |
|---|---|---|---|---|
| 6,061,025 | A | 5/2000 | Jackson et al. | |
| 6,765,536 | B2 | 7/2004 | Phillips et al. | |
| 6,987,493 | B2 | 1/2006 | Chen | |
| 7,068,234 | B2 | 6/2006 | Sievenpiper | |
| 7,215,289 | B2 | 5/2007 | Harano | |
| 7,830,320 | B2 | 11/2010 | Shamblin | |
| 7,911,402 | B2 | 3/2011 | Rowson et al. | |
| 8,362,962 | B2 | 1/2013 | Rowson et al. | |
| 8,446,318 | B2 | 5/2013 | Ali et al. | |
| 8,648,755 | B2 | 2/2014 | Rowson et al. | |
| 8,717,241 | B2 | 5/2014 | Shamblin et al. | |
| 9,065,496 | B2 | 6/2015 | Rowson et al. | |
| 9,231,669 | B2 | 1/2016 | Desclos et al. | |
| 9,240,634 | B2 | 1/2016 | Rowson et al. | |
| 9,425,497 | B2 | 8/2016 | Pajona et al. | |
| 9,439,151 | B2 | 9/2016 | Zhu et al. | |
| 9,479,242 | B2 | 10/2016 | Desclos et al. | |
| 9,590,703 | B2 | 3/2017 | Desclos et al. | |
| 9,755,305 | B2 | 9/2017 | Deslos et al. | |
| 9,755,580 | B2 | 9/2017 | Desclos et al. | |
| 2009/0051611 | A1* | 2/2009 | Shamblin | H01Q 1/243 343/747 |
| 2011/0175791 | A1 | 7/2011 | Ozdemir et al. | |
| 2015/0222020 | A1* | 8/2015 | Tai | H01Q 1/243 343/745 |
| 2016/0036127 | A1* | 2/2016 | Desclos | H01Q 5/328 343/745 |
| 2016/0043467 | A1* | 2/2016 | Desclos | H01Q 5/328 343/745 |
| 2018/0351255 | A1* | 12/2018 | Singh | H01Q 5/378 |

OTHER PUBLICATIONS

International Preliminary Report on Patentabillity for corresponding PCT Application No. PCT/US2017/063528, dated May 28, 2019, 5 pages.

* cited by examiner

ACTIVE UHF/VHF ANTENNA

CROSS-REFERENCE TO RELATED APPLICATIONS

This application claims benefit of priority with commonly owned and U.S. Provisional Application Ser. No. 62/427,071, filed Nov. 28, 2016; the entire contents of which are hereby incorporated by reference.

BACKGROUND

Field of the Invention

This invention relates to antennas for signal reception in UHF and VHF bands; and more particularly, to active antennas capable of dynamic tuning to achieve improved signal performance in the UHF and VHF bands.

Description of the Related Art

Ultra-high frequency (UHF) bands span the range between 470 MHz and 698 MHz. Very high frequency (VHF) bands span the range between 30 MHz to 300 MHz. In North America, VHF Band 1 ("VHF1") includes channels 2 thru 6 and spans range of 54 MHz to 88 MHz. Also in North America, VHF Band 2 ("VHF2") includes channels 7-13 and spans the range of 174 MHz thru 216 MHz. Each of these bands is utilized for over-the-air ("OTA") television signaling, also known as "broadcast television" or "terrestrial television".

While antennas exist for use with television sets to receive OTA signals, these conventional antennas are saturated with performance limitations and other problems which impede commercial success and end user experiences. High definition services offered by cable television and satellite service providers caused many to leave OTA television for the much improved HD television access.

Satellite television, while available for many years, emerged onto the market as a solution to access premium content channels with high quality for supporting high definition transmissions.

However, with the advent of the internet, and as internet speeds continue to improve with advances in communication technologies, it has become a standard practice for individual consumers to increasingly access streaming media through the internet. As a result, there has been a significant decline in subscription sales to satellite and cable television services.

Today, many consumers prefer to access content through online streaming services, such as HULU® or NETFLIX®, and the like. However, these online streaming services, at least for now, do not offer local television programming such as local news, weather, etc. As such, these customers who prefer internet-streamed media are often without access to local content. In order to fill this void, many of these "cord-cutters" are once again looking to OTA antennas in order to access broadcast television for accessing local television content.

Now that OTA television is becoming relevant again, there is a need for improved antennas which are capable of accessing OTA transmissions, and with improved signaling sufficient to support high definition televisions.

The same limitations of OTA antennas exist today that existed many years ago; i.e., the requirement for strategic placement and elevation for receiving signals, matching requirements and signal conditioning, antenna size, aesthetics, among others.

SUMMARY

Active UHF/VHF antennas are configured to provide the ability to (i) access broadcast television signals, (ii) receive and deliver optimal signaling and quality to the television display, and (iii) integrate with the TV receiver to optimize a mode of the antenna for accessing the desired channel.

Three embodiments are illustrated, wherein in each of the embodiments an active UHF/VHF antenna is provided having an antenna element positioned adjacent to a ground plane, and a parasitic element positioned adjacent to each of the antenna element and the ground plane, wherein the parasitic element is coupled to the ground plane at a multi-port switch configured to open, short, or reactively load the parasitic element. The multi-port switch is further coupled to a microprocessor, which, in turn, is further coupled to a television receiver. As a user selects a television channel for viewing, the receiver chipset is configured to communicate one or more control signals to the microprocessor, and the microprocessor samples data from memory to determine an optimal mode for reconfiguring the active UHF/VHF antenna. For example, receive signal strength indicator (RSSI) can be sampled from each mode of the antenna, and an optimal mode of each of the modes is selected, wherein the multi-port switch is configured by the microprocessor communicating a signal to the multi-port switch for activating the corresponding switch port(s) and inducing the desired antenna mode.

Various configurations of antenna element and parasitic element structures are contemplated and disclosed.

Additionally, various configurations of passive components, active components, and filters are contemplated and disclosed.

The result of these embodiments is provided an active UHF/VHF antenna capable of significantly improved signal reception in the UHF and VHF bands.

Other features and advantages will be recognized by those with skill in the art upon a thorough review of the following descriptive examples and detailed embodiments.

DETAILED DESCRIPTION OF THE PREFERRED EMBODIMENTS

Figure 1:
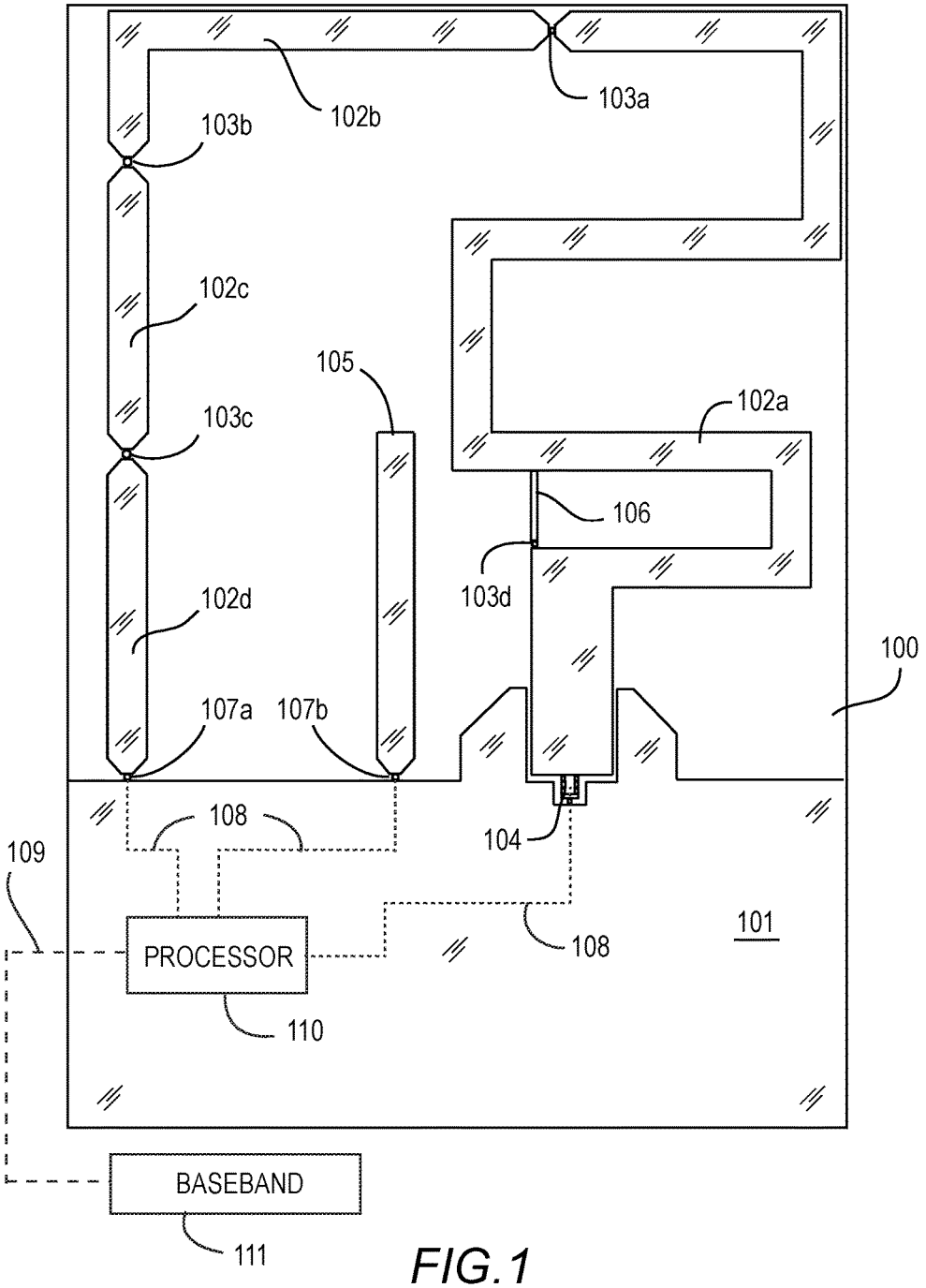
FIG. 1 shows an active UHF/VHF antenna in accordance with a first illustrated embodiment.

In the following description, for purposes of explanation and not limitation, details and descriptions are set forth in order to provide a thorough understanding of the present invention in accordance with an illustrated embodiment.

However, it will be apparent to those skilled in the art that the present invention may be practiced in other embodiments that depart from these details and descriptions without departing from the spirit and scope of the invention. An illustrated embodiment will be described below with reference to the drawings wherein illustrative features are denoted by reference numerals.

Example 1

In a first illustrated embodiment, as illustrated in FIG. 1, an active UHF/VHF antenna is formed on a substrate 100 and includes: an antenna element 102*a* positioned adjacent to a ground plane 101, the antenna element is coupled to one or more conductor elements 102*b*; 102*c*; 102*d* in a series extension; wherein between the antenna element 102*a* and a first conductor 102*b* of the one or more conductor elements is disposed a first component, first plurality of components, or first filter 103*a* configured to pass VHF1 and VHF2 signals to the first conductor 102*b*; and wherein between the first conductor 102*b* and a second conductor 102*c* is disposed a second component, second plurality of components, or second filter 103*b* configured to pass VHF1 signals. In this regard, the antenna element 102*a*, first conductor 102*b*, second and subsequent conductors 102*c*; 102*d*, etc. form an antenna with multiple resonances. Up to "n" conductors can be linked each with a component, plurality of components, or filter disposed between the $n^{th}$ conductor and $(n-1)^{th}$ conductor. The $n^{th}$ component(s) or filter being configured to pass one or more desired signals and block unwanted signals.

Here, the antenna element 102*a* is coupled to a first conductor 102*b* at a first filter 103*a*; a second conductor 102*c* is coupled to the first conductor 102*b* at a second filter 103*b*; and a third conductor 102*d* is coupled to the second conductor 102*c* at a third filter 103*c*. While this example illustrates a first preferred embodiment, it should be understood that any number of conductors and filters may be similarly implemented to achieve the same result. Moreover, the length, position, orientation and relation of these features can be varied to achieve desired antenna performance as would be understood by those having skill in the art.

In the illustrated embodiment, the third conductor 102*d* is further coupled to the ground plane at a first multi-port switch 107*a*. The first multi-port switch can be configured with multiple ports, wherein each of the ports is capable of open-circuiting, short-circuiting, or coupling a reactive loading to the third conductor. As a result, the first multi-port switch 107*a* is capable of adjusting a reactance associated with the antenna with multiple resonances, and/or can be used to open/short the third conductor to ground. This first multi-port switch provides a first means for actively controlling the antenna function.

Each of the first through third filters 103*a*; 103*b*; and 103*c*, respectively, can be configured as: (i) a passive reactance component or "passive component", such as a capacitor or inductor; (ii) a circuit comprising two or more passive components, such as an LC circuit (inductor and capacitor); or (iii) a filter, such as a low pass filter. Those with skill in the art will be able to appreciate the various components and arrangements of components which will filter out signals at each of the "filters" 103*a* thru 103*c*.

In the instant example, the first filter 103*a* may comprise an LC circuit; the second filter 103*b* may comprise a low pass filter; and third filter 103*c* may comprise a passive inductor. In yet another example, one or more of the first through third filters may comprise a tunable component, such as a tunable capacitor, tunable inductor, or other tunable component known by those having skill in the art.

Now, the antenna is further characterized by a parasitic element 105 positioned adjacent to the antenna element 102*a*, the parasitic element 105 being coupled to the ground plane 101 via a second multi-port switch 107*b*. The second multi-port switch 107*b* may be configured to open-circuit, short-circuit, or reactively load the parasitic element. These changes to the reactive loading of the parasitic element tend to induce a radiation pattern change about the antenna element and conductors extending therefrom. In this regard, the antenna assembly as a whole (antenna element, conductors, parasitic element, ground plane, etc.) is configured for active beam steering for changing a radiation pattern mode of the antenna.

The antenna element 102*a* is further shown with a bypass junction 106 for providing a path for high frequency signals. A fourth filter 103*d* is provided to block low frequency signals; the fourth filter is shown with a passive capacitor, however, a tunable capacitor can be similarly implemented between the feed 104 and the bypass junction 106.

Each of the first multi-port switch 107*a*; second multi-port switch 107*b*, and the feed 104 may be coupled to a microprocessor 110 via transmission lines 108 extending therebetween as shown. Here, the microprocessor is configured to communicate one or more signals to each of the first and second multi-port switches for controlling a switch state or activating switch ports. Additionally, the microprocessor can be configured to control a matching circuit associated with the antenna feed. The matching circuit may be incorporated into the microprocessor, or positioned outside the processor, and generally comprises one or a plurality of passive and/or active reactance components, such as capacitors, inductors, and tunable variants thereof as known by those with skill in the art. A function of the microprocessor 110 is to determine a mode for configuring the active UHF/VHF antenna, and sending control signals to configure the antenna in the desired mode. The processor may further comprise a memory module and an algorithm resident in the memory module, the algorithm configured to determine the optimal antenna mode, and through the processor, communicate the proper settings for configuring the antenna in the desired mode.

The microprocessor 110 is generally coupled to a television receiver/baseband 111. As a user selects a channel, the receiver communicates the desired channel information to the processor, which in turn executes the algorithm to determine an optimal antenna mode, and the processor then configures the antenna in the optimal mode. For example, the algorithm can sample a metric such as receive signal strength indicator (RSSI) at each mode of the antenna, and select the optimal mode based on that metric.

While FIG. 1 shows an exemplary embodiment, the illustrated arrangement is not intended to be limiting. In fact, many variations can be implemented in a similar fashion which provides substantially the same results. As such, we follow with additional embodiments for providing a similar active UHF/VHF antenna. Any combination or rearrangement of these features may be implemented to produce a non-illustrated embodiment which is intended to be within the invention as-claimed.

Example 2

Figure 2:
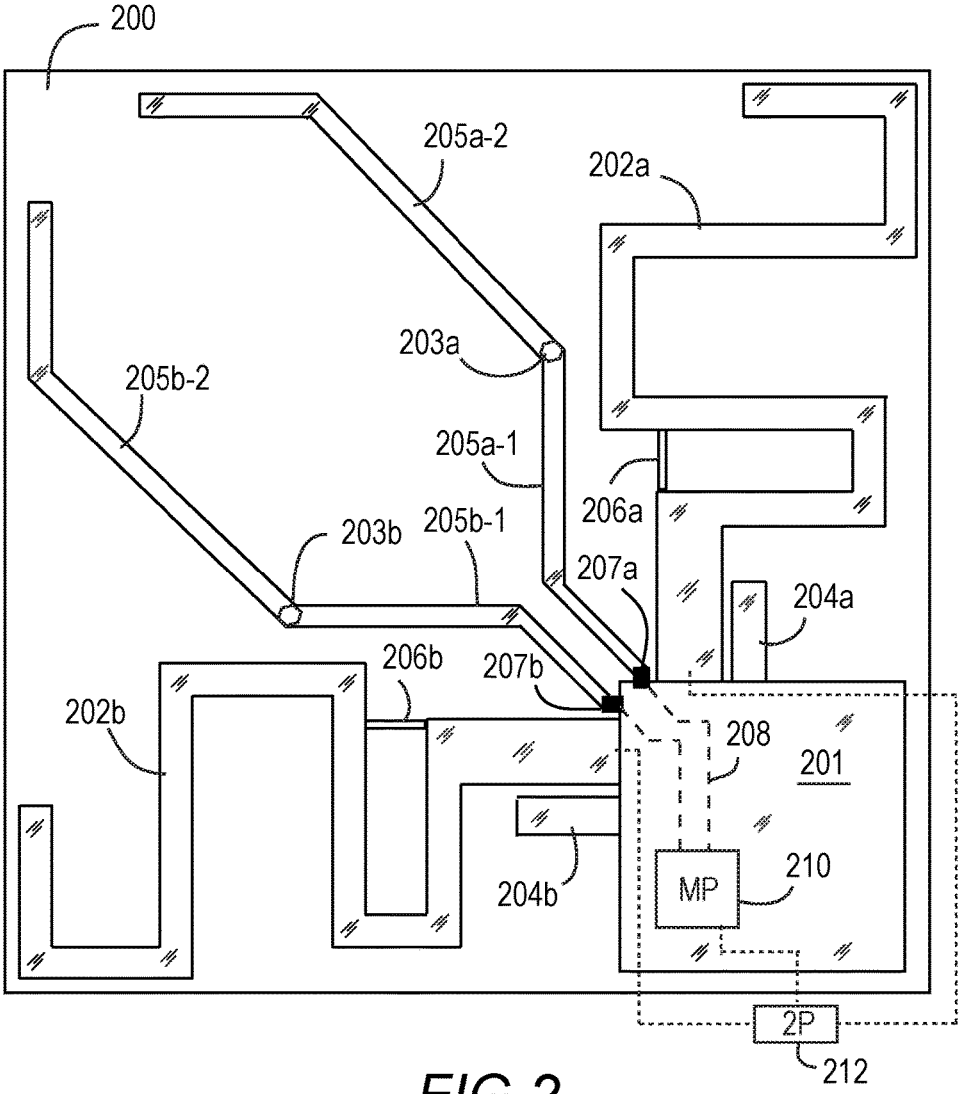
FIG. 2 shows an active UHF/VHF antenna in accordance with a second illustrated embodiment.

Now turning to a second illustrated embodiment as shown in FIG. 2, an active UHF/VHF antenna includes a first antenna element 202*a*, a second antenna element 202*b*, a ground plane 201, and first and second parasitic elements 205*a*; 205*b*, respectively, each formed on a substrate 200. The substrate may comprise a rigid FR4 substrate, a flexible polyimide substrate, or other substrate available to those with skill in the art. The ground plane 201 is formed at a corner of the rectangular substrate. The first antenna element 202*a* extends in a first direction, vertically from the ground plane in orientation with respect to the drawing as shown. The second antenna element extends in a second direction, horizontally from the ground plane in orientation with respect to the drawing as shown. Accordingly, the second antenna element 202*b* is oriented perpendicular to the first antenna element 202*a*. The first and second antenna elements can be configured as one being horizontally polarized, and the other being vertically polarized. The first and second antenna elements are further configured as mirror opposites, or configured to oppose one another. The first antenna element 202*a* further comprises a first bypass junction 206*a* extending between two points along a first bent portion of the first antenna element. Similarly, the second antenna element 202*b* further comprises a second bypass junction 206*b* extending between two points along a first bent portion of the second antenna element. A passive or tunable reactive component may be implemented at the either or both of the first and second bypass junctions 206*a*; 206*b*. The ground plane includes a first ground plane extension 204*a* positioned adjacent to the first antenna element 202*a*; and further includes a second ground plane extension 204*b* positioned adjacent to the second antenna element 202*b*. Each of the first and second ground plane extensions are configured to impedance match the adjacent antenna structures. A two-port switch 212 is implemented with connection to each of the first and second antenna elements 202*a*; 202*b*, respectively, thereby providing a first mode utilizing the first antenna element 202*a*, a second mode utilizing the second antenna element 202*b*, and a third mode utilizing a combined signal of both the first and second antenna elements 202*a* and 202*b*.

A first parasitic element 205*a* is formed by a first portion 205*a*-1 and a second portion 205*a*-2, wherein a first filter 203*a* is disposed between the first and second portions of the first parasitic element. The first parasitic element is positioned adjacent to the first antenna element 202*a*. A first multi-port switch 207*a* is coupled between the first parasitic element and the ground plane. The first multi-port switch is configured to open-circuit, short-circuit, and/or reactively load the first parasitic element.

A second parasitic element 205*b* is formed by a first portion 205*b*-1 and a second portion 205*b*-2, wherein a second filter 203*b* is disposed between the first and second portions of the second parasitic element. The second parasitic element is positioned adjacent to the second antenna element 202*b*. A second multi-port switch 207*b* is coupled between the second parasitic element and the ground plane. The second multi-port switch is configured to open-circuit, short-circuit, and/or reactively load the second parasitic element.

Here, the first and second parasitic elements are arranged to oppose one another; however, any orientation or rearrangement of these features can be similarly implemented by those with skill in the art.

Each of the first and second multi-port switches 207*a*; 207*b*, respectively, are further coupled to a microprocessor 210 via control lines 208 extending therebetween. The microprocessor is configured to couple with a television receiver. In a similar manner, a user can select a channel from the television control, the television receiver or related chipset then sends a request to the microprocessor of the antenna, which in turn determines the optimal mode of the antenna and configures each of the multi-port switches and other tunable components (if any) to configure the antenna in the desired mode for providing optimized signal reception.

Example 3

Now turning to a third illustrated embodiment as shown in FIGS. 3(A-B), a three-dimensional antenna assembly includes a first planar substrate portion 300*a* having a first active UHF/VHF antenna 301*a* thereon, and a second planar substrate portion 300*b* having a second active UHF/VHF antenna 301*b* thereon. The first active UHF/VHF antenna may comprise any structure as described herein, or a modification thereof, however, for illustrative purposes is shown a first active UHF/VHF antenna having a first antenna element 301*a* disposed adjacent to a first ground plane 302. The first ground plane 302 is shown with an optional first ground plane extension 304 for impedance matching the first active antenna. A first feed 303 is used to communicate signals between the first antenna element and the receiver. A first bypass junction 306 is shown for providing a distinct path for high-frequency signals. A first parasitic element 305 with a first section 305*a* and a second section 305*b* is shown. The first section may optionally be separated from the second section by one or more first passive and/or active components, or first filters; though none is shown in this illustrated embodiment. The first parasitic element 305 is however coupled to the first ground plane at a first multi-port switch. The first multi-port switch 307 may comprise any number of ports, or "n"-ports, wherein each port is individually selected to open-circuit, short circuit, or reactively load the first parasitic element. A first microprocessor 310 is shown coupled to the first multi-port switch, the first microprocessor receives signals from baseband, or a receiver circuit, in a television unit; the signals include information related to the user-selected channel, wherein the first microprocessor is configured to determine an optimal mode of the first UHF/VHF antenna for receiving the desired channel. The first microprocessor may sample up to all possible modes of the first active antenna, and select the mode exhibiting the optimal metric, such as RSSI, etc. Once a mode is selected, control signals are communicated to the first multi-port switch for configuring the first active antenna in the desired mode.

Figure 3A:
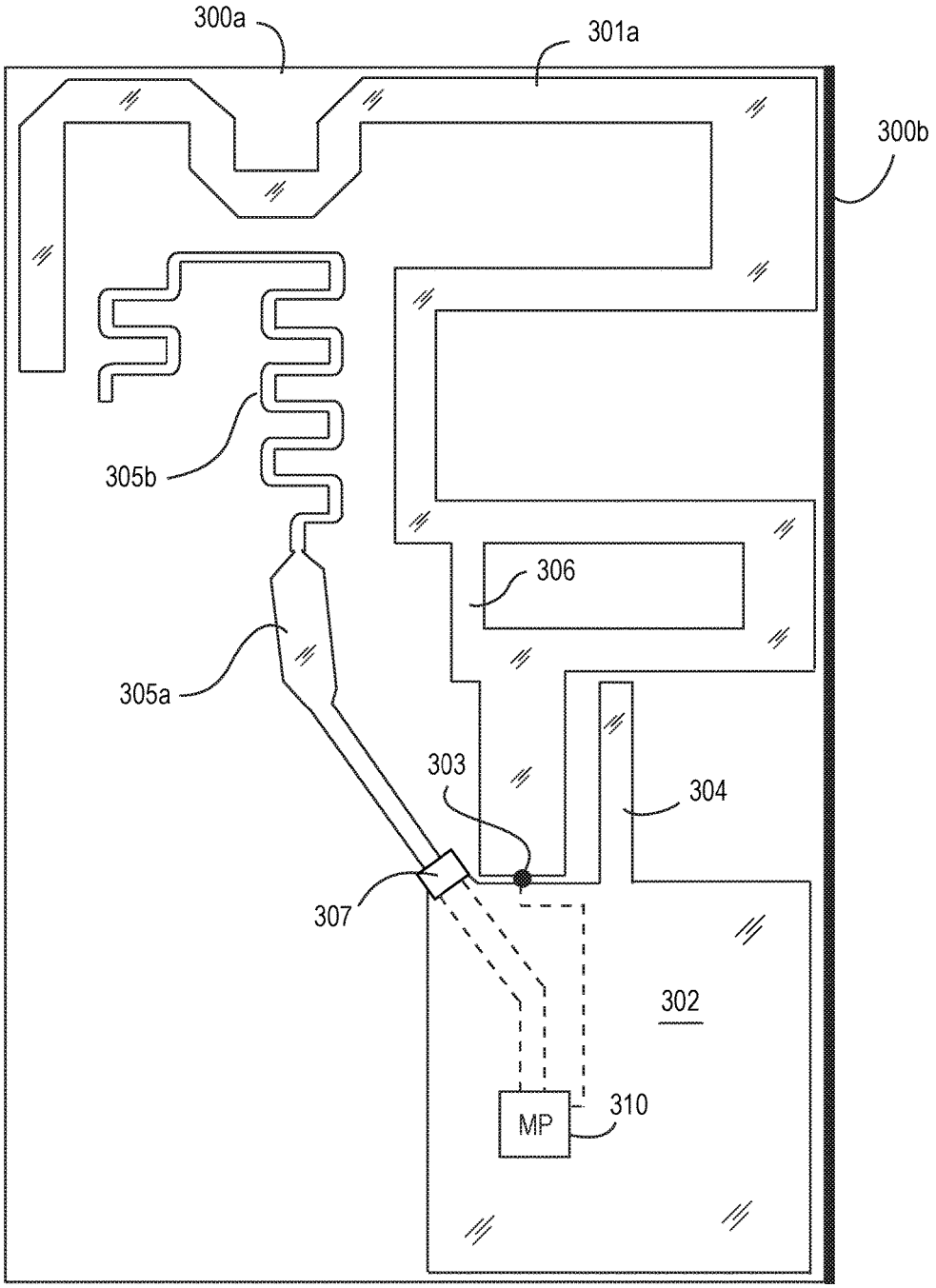
FIG. 3A shows a plan view of an active UHF/VHF antenna in accordance with a third illustrated embodiment.
Figure 3B:
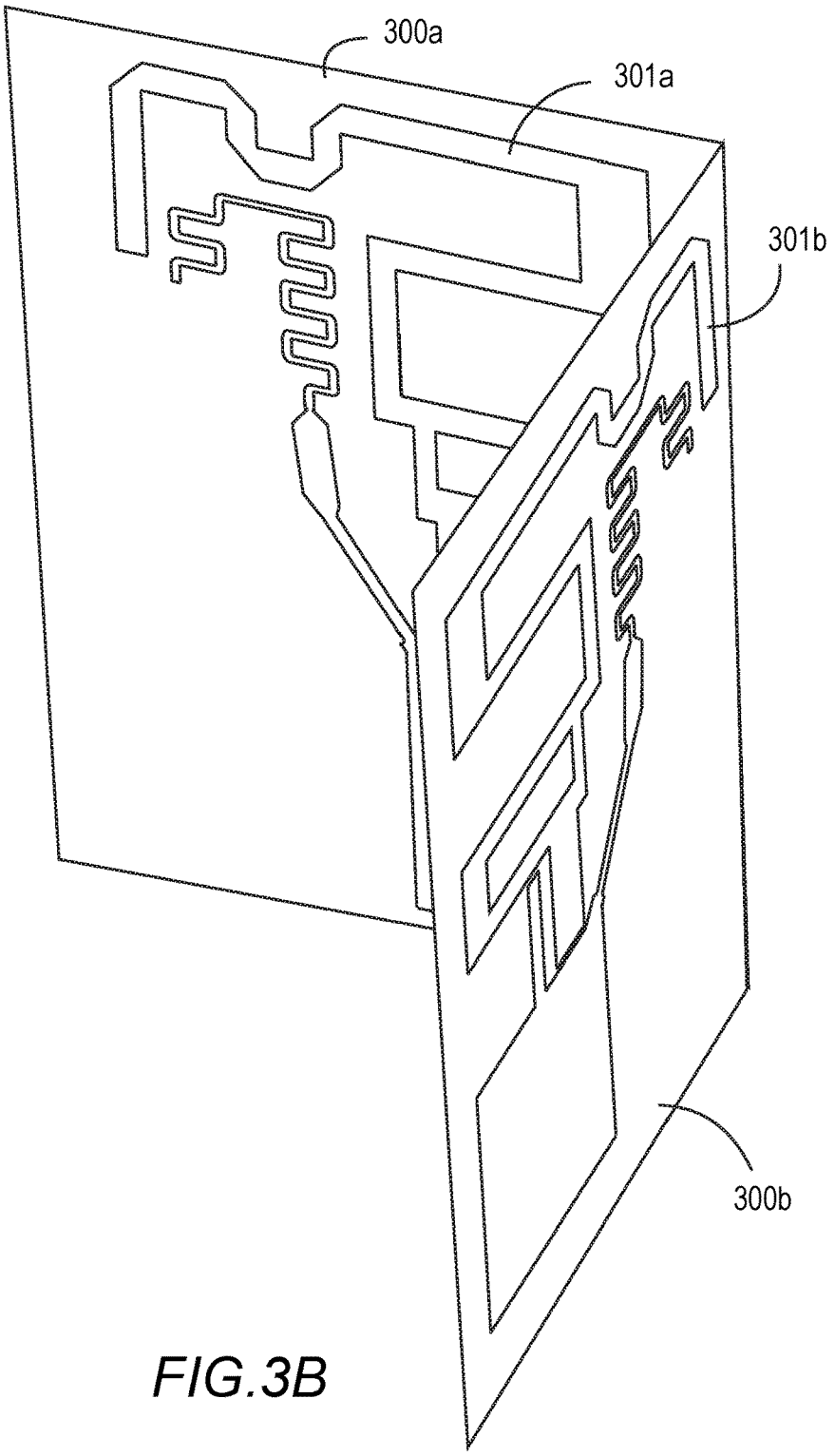
FIG. 3B shows a perspective view of the active UHF/VHF antenna in accordance with the third illustrated embodiment.

The second planar substrate 300*b* is shown extending out of the page in FIG. 3A, and is configured orthogonal with respect to the first planar substrate 300*a*. FIG. 3B further shows the antenna of FIG. 3A from a perspective view, wherein it can be recognized that a second active UHF/VHF antenna 301*b* is positioned on the second planar substrate 300*b*. The first microprocessor may be used to control both the first and second active antennas; or multiple microprocessors may be implemented.

The second antenna 301*b* may be oriented perpendicular with regard to the first antenna 301*a*; or at any angle as desired. Additionally, the second antenna 301*b* may be a mirror image of the first antenna, or the first and second antennas may be of the same orientation.

Figure 4:
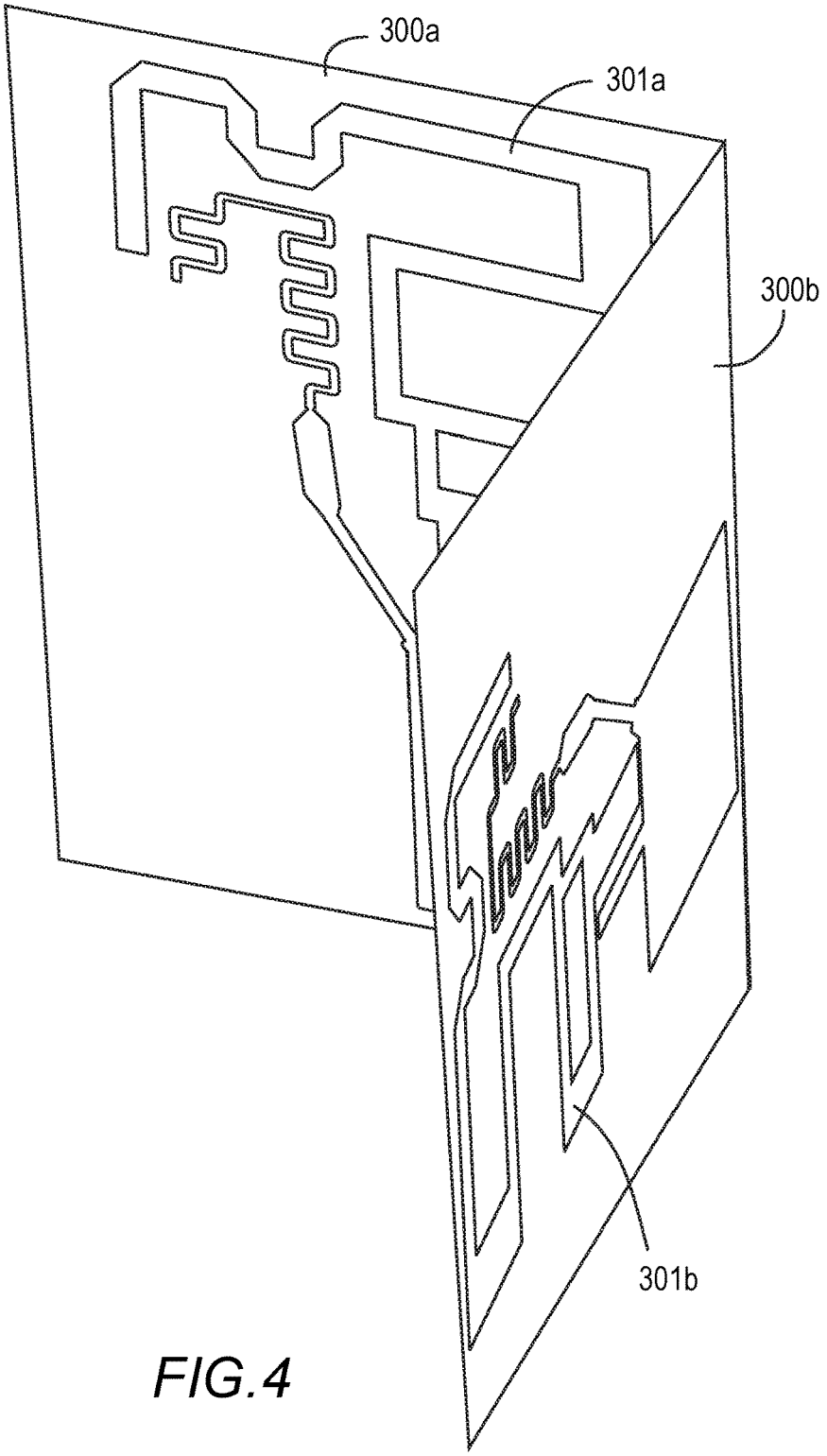
FIG. 4 shows a perspective view of the active UHF/VHF antenna in accordance with another embodiment.

Any change in orientation of the second antenna with respect to the first may be similarly implemented as is illustrated in FIG. 4.

The radiation pattern of the first antenna, second antenna, or a combination of the first and second antennas may be used for reception of signals.

Figure 5:
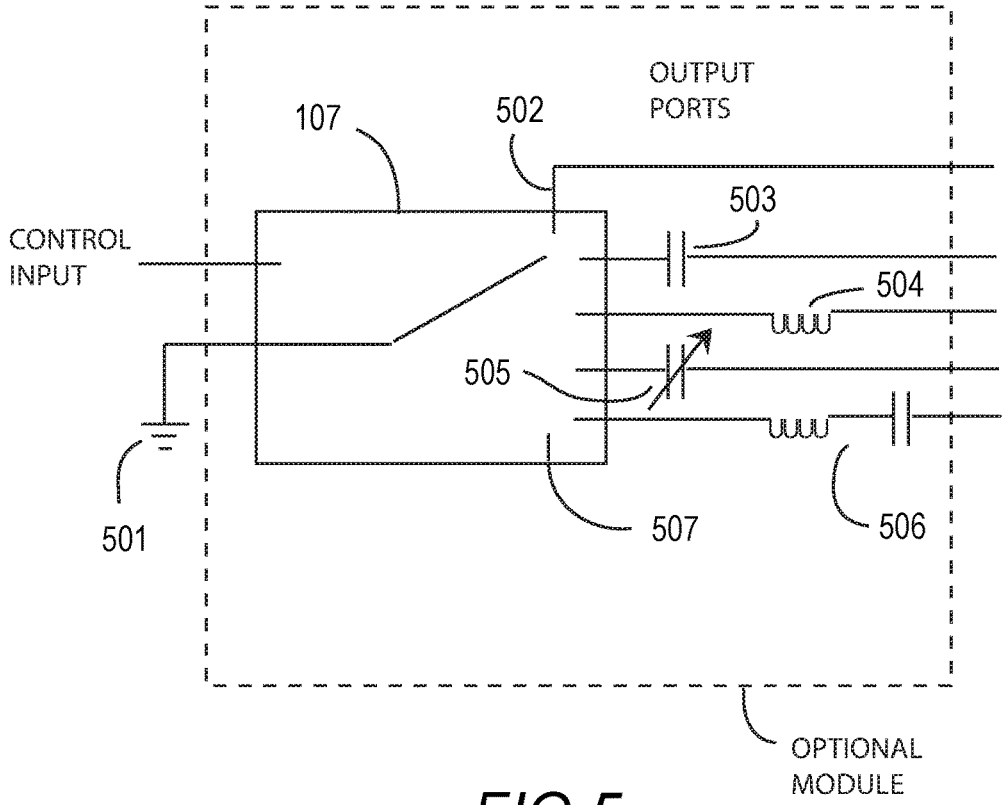
FIG. 5 shows an example of a multi-port switch with capacitive and inductive loadings for use with any of the embodiments herein.

FIG. 5 shows one example of a multi-port switch that can be implemented in any of the above embodiments. While the switch is being illustrated in FIG. 5, it should be understood by those with skill in the art that a switch with any number of ports, and any configuration, may be alternatively implemented, such that the result is the ability to open-circuit, short-circuit, or reactively load an antenna feature such as a parasitic element. The illustrated multi-port switch includes switch 107 coupled to ground 501, and configured to short circuit via output port 502, reactively load via output ports 503; 504; 505; and 506, or open circuit at port 507. Port 503 shows a passive capacitor for reactively loading the antenna feature coupled to the multi-port switch 107. Port 504 shows a passive inductor for reactively loading the antenna feature coupled to the multi-port switch 107. Port 505 shows a tunable capacitor for reactively loading the antenna feature coupled to the multi-port switch 107. Port 506 shows a plurality of passive components for reactively loading the antenna feature coupled to the multi-port switch 107. Control input signals from the microprocessor are provided to the multi-port switch for configuring the switch with the selected port or path for placing the antenna in a desired mode. The switch and reactive component(s) may be configured as a circuit on the antenna substrate, or may be implemented in a unitary module, as shown.

Other embodiments or variations will be recognized by those having skill in the art.

What is claimed is:

1. An active antenna, comprising:

a first substrate;

a first antenna element positioned on the first substrate adjacent to a ground plane, the first antenna element coupled to a first conductor at a first filter, the first antenna element further coupled to a second conductor at a second filter, the first antenna element configured for multiple resonances in the UHF and VHF bands;

a first parasitic element positioned adjacent to the first antenna element and the ground plane, wherein the first parasitic element is coupled to the ground plane at a first multi-port switch;

the first multi-port switch configured to open-circuit, short-circuit, or reactively load the first parasitic element;

the first multi-port switch coupled to a first processor, and the first processor configured to further couple with a television receiver circuit, wherein the first processor is configured to receive channel selection information from the television receiver circuit, and using an algorithm resident in the first processor, determine an optimal mode of the active antenna, and communicate control signals to the first multi-port switch for configuring the active antenna in the optimal mode.

2. The active antenna of claim 1, wherein the first processor is further configured to control a first matching circuit for matching the first antenna element at a first antenna feed.

3. The active antenna of claim 1, wherein the first filter comprises an LC circuit.

4. The active antenna of claim 1, wherein the second filter comprises a low pass filter.

5. The active antenna of claim 1, wherein the second conductor is further coupled to a third conductor at a third filter.

6. The active antenna of claim 5, wherein the third filter comprises an inductor.

7. The active antenna of claim 5, wherein the third conductor is further coupled to the ground plane at a second multi-port switch.

8. The active antenna of claim 7, wherein each of the first and second multi-port switches are coupled to the first processor and configured to receive control signals therefrom for independently controlling a state of each of the first and second multi-port switches.

9. The active antenna of claim 5, wherein each of the first through third filters individually comprises: a passive reactive component, a tunable reactive component, a plurality of reactive components, or a combination thereof.

10. The active antenna of claim 1, wherein the first antenna element comprises a first bypass junction for providing a reduced electrical path for high frequency signals.

11. The active antenna of claim 1, wherein the optimal mode is determined by the algorithm based on receive signal strength indicator (RSSI) sampled from the active antenna in up to each of a plurality of possible modes.

12. The active antenna of claim 11, wherein the optimal mode is the mode of the antenna with optimum RSSI from all available modes.

13. The active antenna of claim 11, wherein the optimal mode is the first mode discovered by the first processor achieving a minimum acceptable RSSI.

14. The active antenna of claim 1, further comprising a first ground plane extension disposed adjacent to the first antenna element.

15. The active antenna of claim 1, further comprising a second antenna element and a second parasitic element positioned adjacent to the second antenna element, wherein the second antenna element is oriented perpendicular with respect to the first antenna element.

16. The active antenna of claim 15, wherein the second antenna element and the second parasitic element are configured as mirror opposites of the first antenna element and the first parasitic element.

17. The active antenna of claim 15, further comprising a two-port switch coupled to each of the first and second antenna elements and further coupled to the processor, wherein the two-port switch is configured to select the first antenna element, the second antenna element, or a combination of the first and second antenna elements for signaling.

18. The active antenna of claim 1, further comprising a second substrate oriented perpendicular with respect to the first substrate, the second substrate comprising a second antenna element and a second parasitic element disposed thereon.

19. The active antenna of claim 18, wherein the second antenna element is arranged at a ninety degree angle with respect to the first antenna element.

20. The active antenna of claim 19, wherein the second antenna element is further arranged as a mirror image with respect to the first antenna element.

21. The active antenna of claim 19, wherein the second antenna element is further rotated with respect to the first antenna element.

* * * * *